US008158321B2

(12) United States Patent
Teishev et al.

(10) Patent No.: US 8,158,321 B2
(45) **Date of Patent: *Apr. 17, 2012**

(54) METHOD AND APPARATUS FOR LIQUID ELECTROSTATIC PRINTING

(75) Inventors: Albert Teishev, Rishon le-zion (IL); Muhammad Iraqi, Tira (IL); Gregory Katz, Holon (IL)

(73) Assignee: Hewlett-Packard Development Company, L.P., Houston, TX (US)

( * ) Notice: Subject to any disclaimer, the term of this patent is extended or adjusted under 35 U.S.C. 154(b) by 909 days.

This patent is subject to a terminal disclaimer.

(21) Appl. No.: 11/996,856

(22) PCT Filed: Jul. 27, 2005

(86) PCT No.: PCT/US2005/026627

§ 371 (c)(1),
(2), (4) Date: Aug. 21, 2008

(87) PCT Pub. No.: WO2007/018503

PCT Pub. Date: Feb. 15, 2007

(65) Prior Publication Data

US 2009/0226839 A1 Sep. 10, 2009

(51) Int. Cl.
*G03G 9/12* (2006.01)

(52) U.S. Cl. ..... 430/115; 430/116

(58) Field of Classification Search ..... 430/115, 430/116

See application file for complete search history.

(56) References Cited

U.S. PATENT DOCUMENTS

| | | | | |
|---|---|---|---|---|
| 5,212,526 | A | 5/1993 | Domoto et al. | |
| 5,364,726 | A | 11/1994 | Morrison et al. | |
| 7,544,458 | B2 * | 6/2009 | Iraqi et al. | 430/115 |

FOREIGN PATENT DOCUMENTS

| | | |
|---|---|---|
| DE | 19511476 | 11/1995 |
| JP | 62098364 | 10/1987 |
| WO | 2005109110 | 11/2005 |

* cited by examiner

*Primary Examiner* — Hoa V Le

(57) ABSTRACT

Novel UV-curable liquid toner compositions, methods for preparing same and imaging processes and apparatus utilizing same are provided. The UV-curable liquid toner compositions include a dispersion of toner particles in a hydrocarbon based liquid carrier and one or more UV-curable component(s) which form a part of the carrier.

33 Claims, 6 Drawing Sheets

METHOD AND APPARATUS FOR LIQUID ELECTROSTATIC PRINTING

RELATED APPLICATIONS

This patent application claims priority to PCT/US2005/026627, titled "Method and Apparatus for Liquid Electrostatic Printing", filed on 27 Jul. 2005, and amended on 18 May 2007, commonly assigned herewith, and hereby incorporated by reference.

FIELD AND BACKGROUND OF THE INVENTION

The present invention relates to digital printing and, more particularly, to a method and apparatus for electrostatic printing using a liquid toner.

Electrostatic printing is an effective method of image transfer. In a typical electrostatic printing process, a latent electrostatic image is first formed on an imaging surface (e.g., a photoconductor drum) by forming a uniform electrostatic charge on the imaging surface, and exposing it to a beam of light modulated by the image to be printed. The exposure procedure results in charged and discharged portions of the imaging surface, whereby charged portions form the print image and discharged portions form the background thereof. The latent electrostatic image is then developed, for example, by applying toner which adheres to the charged portions of the surface. The toner is subsequently transferred onto a print substrate, such as a sheet of paper.

One method to transfer the toner is by passing the print substrate between a roller and the imaging surface. During the toner transfer, electrostatic forces between the roller and the toner attract the toner away from the surface of the photoconductor drum onto the substrate. The toner is then subjected to a fixation process, also known as fusing, to the substrate.

However, it is impossible in practical application to transfer all of the toner to the transfer substrate, and a residual amount remains on the imaging surface and must be removed prior to a subsequent electrostatic printing operation. From an economic standpoint, it is desirable to recycle rather than discard the residual toner after such removal.

The toners used in electrostatic printing must have a number of different properties for each step in the process. For example, in order to adhere the toner to the electrical latent image in the developing step, the toner must maintain a suitable 30 amount of charge without being affected by the temperature or humidity of the surrounding environment. Also, in a fixation step in which a heated roller fixing system is used, the toner must have an anti-offset property so as not to stick to heated rollers, while having satisfactory fixability onto the substrate. Blocking resistance is also required to prevent the toner from undergoing blocking during storage in the apparatus.

Electrostatic printing may employ either dry toner or liquid toner (e.g., liquid ink). The quality of the image is related to the size of the toner particles. While it is thought that very fine particles will produce a finer image, there is a practical limitation on the size of toner particles that can be used. Dry toner particles must be of sufficient weight and size to be deposited onto the print surface without becoming airborne, which is thought to lead to machinery forming and, possibly, environmental problems. Additionally, it is difficult to recycle an electrostatic printing employing dry toner cannot be based on the use of recyclable toner, because the removal and collection of residual dry toner particles for the purpose of re-use is hampered, e.g., by the forces of dry friction.

Liquid toners have the advantage of being dispersed in a solvent, thus facilitating the use of very fine colorant particles without concern for the particles becoming airborne. In addition, the recycling of liquid toner is commonly practiced in the art of electrostatic printing because the residual liquid toner can be allowed to flow downwardly under the force of gravity. Liquid toners are obtained by mixing a certain amount of toner in a carrier liquid, which is typically selected to be a highly resistant or insulating liquid (e.g., petroleum solvent), so as to facilitate efficient toner transfer.

In addition, offset-preventing and release facilitating oil, such as silicone oil, is often used so as to increase the efficiency of toner transfer from the imaging surface.

When using liquid toners, there is a need to remove the carrier liquid from the imaging surface after the toner has been applied thereto. This prevents the carrier liquid from being transferred from the imaging surface to the print substrate. Removal of the carrier liquid is necessary for various reasons, including recycling, environmental concerns and image quality (e.g., mechanical strength). A conventional electrostatic printing apparatus therefore employs a squeegee roller or another device which removes excess liquid from the imaging surface and partially dries the liquid image prior to the toner transfer process.

The removal of the excess liquid typically results in a viscous film on the blanket, which includes more than 90% solid particles, with the balance being the carrier liquid. While the transfer process is typically performed under elevated temperature (e.g., 90° C.), during and subsequent to the transfer process most of the remaining carrier evaporates.

Due to the high viscosity of the film, the carrier evaporation sometimes results in the formation of a non-continuous and/or non-uniform film onto the substrate. The performance of the transfer process may further be adversely affected by less than optimal adhesion of the toner particles to the substrate.

The non-optimal adhesion of the toner particles and the formation of a non-continuous and/or non-uniform film onto the substrate may lead to at least partial peeling and flaking of the image from the substrate.

In order to improve the fixing properties of the toner, namely the peeling and flaking resistance, a variety of substances and/or techniques have been used hitherto. These include, for example, linear and cross-linked binding resins (e.g., polyesters, styrene-acrylic resins and the like), as well as other additives (e.g., oils, carboxylic acids) or increasing the pigment loading, which results in reduced amount of the liquid carrier and thus in a more rapid drying process. Exemplary substances and/or techniques for improving the liquid toner fixation are described for example, in U.S. Patent Application Publication No. 20040219448, and U.S. Pat. Nos. 6,656,655 and 6,140,002.

However, while the presently known substances may provide for enhanced fixability, the incorporation thereof in the toner oftentimes affects the charge characteristics and the humidity resistance of the toner, which may adversely affect the quality of the resulting image, as discussed hereinabove. Increasing the pigment loading may similarly adversely affect the image quality.

In a search for methods of improving the performance of liquid toners images, particularly with respect to the adhesion of the toner particles, the continuity and the uniformity of the formed image, the present inventors have envisioned that incorporating a UV-curable component in a liquid toner and UV-irradiating the substrate after the liquid toner is transferred thereto, would result in enhanced adhesion, continuity and/or uniformity of the toner particles to the substrate and thus images with high performance in terms of peeling and flaking resistance would be obtained.

Some UV-curable liquid toners have been reported in the art. U.S. Pat. Nos. 6,653,041, 5,395,724 and 5,212,526, for example, teach liquid toners in which at least a major portion of the liquid carrier and typically the entire liquid toner is UV-curable. Thus, according to the teachings of these patents, toner particles are suspended or dissolved in a UV-curable resin, which serves as the liquid carrier. Exemplary UV-curable liquid carriers that are taught in these patents include monomers, dimers and oligomers of acrylates and methacrylates, vinyl ethers, styrenes, indenes, alpha-olefins, butadienes, and the like. As is discussed hereinabove, such compounds, when forming the liquid carrier in electrostatic printing, may possibly affect the charge characteristics and the humidity resistance of the toner, which, in turn, may adversely affect the quality of the resulting image.

U.S. Pat. No. 5,905,012 discloses an imaging process in which a dry toner image is formed and fused on a substrate and UV-curable toner particles are thereafter deposited and cured on the image. This process therefore involves the use of two different types of toners and therefore substantially reduces the efficiency as well as the cost-efficiency of the process.

There is thus a widely recognized need for, and it would be highly advantageous to have a novel liquid toner composition for electrostatic printing and an imaging process and apparatus utilizing same, for providing images with exceptional resistance to peeling and flaking, devoid of the above limitations.

SUMMARY OF THE INVENTION

While reducing the present invention to practice, UV-curable liquid toner compositions, which comprise hydrocarbon-based liquid carrier, toner particles dispersed therein and a UV-curable component that renders the composition highly reactive when exposed to UV irradiation, have been successfully prepared and employed in liquid electrostatic printing processes, resulting in images with improved peeling and flaking resistance without affecting other characteristics of the liquid toner that are required for an efficient printing process.

Thus, according to one aspect of the present invention, there is provided a UV-curable liquid toner composition for use in electrostatic printing, which comprises a dispersion of toner particles suspended in a hydrocarbon-based liquid carrier; and at least one UV-curable component.

According to further features in embodiments of the invention described below, a concentration of the at least one UV-curable component ranges from about 0.5 weight percentages to about 5 weight percentages of the total weight of the composition, or from about 1 weight percentages to about 3 weight percentages of the total weight of the composition.

According to still further features in the described embodiments the UV-curable component comprises at least one UV-polymerizable compound.

According to still further features in the described embodiments the at least one W-polymerizable compound comprises at least one acrylate.

According to still further features in the described embodiments the at least one acrylate is selected from the group consisting of a monoacrylate (e.g., isodecyl acrylate, isobornyl acrylate), a diacrylate (e.g., dipropylene glycol diacrylates) and a mixture thereof.

According to still further features in the described embodiments the concentration of the UV-polymerizable compound ranges from about 75 weight percentages to about 95 weight percentages of the total weight of the UV-curable component.

According to still further features in the described embodiments the UV-curable component further comprises at least one photoinitiator.

According to still further features in the described embodiments the UV-curable component further comprises at least one stabilizer.

According to still further features in the described embodiments the hydrocarbon-based liquid carrier comprises at least one aliphatic hydrocarbon selected from the group consisting of ISOPAR-G, ISOPAR-H, ISOPAR-L and ISOPAR-M. ISOPAR is a collective brand name of various high-purity isoparaffinic solvents with narrow boiling ranges and a minimal amount of impurities, such as aromatics, unsaturated olefins and reactive polar compounds. Thus, ISOPAR-G is obtained at a distillation temperature of 160-176° C., ISOPAR-H is obtained at a distillation temperature of 178-188° C., ISOPAR-1 is obtained at a distillation temperature of 189-207° C., and ISOPAR-M is obtained at a distillation temperature of 123-154° C.

Representative examples of UV-curable liquid toner compositions according to the present invention are those comprising: about 2 weight percentages of the toner particles; about 0.5-5 weight percentages of the at least one UV-curable component; and about 90-97.5 weight percentages of the hydrocarbon-based liquid carrier.

Representative examples of UV-curable components according to the present invention are those comprising about 75-95 weight percentages of at least one UV-polymerizable compound selected from the group consisting of a monoacrylate and a diacrylate; about 5-10 weight percentages of at least one photoinitiator; and about 0.1-0.5 weight percentages of at least one stabilizer.

According to another aspect of the present invention there is provided a process of preparing the UV-curable liquid toner compositions described hereinabove. The process comprises providing the at least one UV-curable component; and dissolving the at least one UV-curable component in the dispersion of toner particles in the hydrocarbon-based liquid carrier, thereby providing the UV-curable liquid toner composition.

In an exemplary process, where the UV-curable component comprises one or more of a UV-polymerizable compound, a photoinitiator and a stabilizer, providing the UV-curable component is effected by dissolving the photoinitiator(s) and the stabilizer(s) in the UV-polymerizable compound(s).

According to still another aspect of the present invention, there is provided a method of forming an image on a substrate. The method comprises: providing the UV-curable liquid toner composition described hereinabove; forming an electrostatic image on an imaging surface; developing the electrostatic image using the UV curable liquid toner composition, to thereby form a toner image containing the UV-curable composition; transferring the toner image to the substrate; and UV-irradiating the substrate, to thereby cure the image on the substrate.

According to further features in embodiments of the invention described below, forming the electrostatic image on the imaging surface comprises uniformly charging the imaging surface.

According to still further features in the described embodiments forming the 5 electrostatic image on the imaging surface further comprises emitting light constituting an image on the imaging surface, so as to selectively discharge predetermined regions on the imaging surface.

According to still further features in the described embodiments developing the electrostatic image comprises charging the UV curable liquid toner composition and applying the UV curable liquid toner composition onto the imaging surface.

According to still further features in the described embodiments the application of the UV curable liquid toner composition onto the imaging surface is by a sprayer.

According to still further features in the described embodiments the application of the UV curable liquid toner composition onto the imaging surface is by a developing roller.

According to still further features in the described embodiments the method further comprises transferring the toner image to an intermediate transfer member, prior to the transfer of the toner image to the substrate.

According to still further features in the described embodiments the method further comprises squeezing the toner image prior to the transfer of the toner image to the substrate.

According to yet another aspect of the present invention there is provided a liquid electrostatic printing apparatus, which comprises: an imaging assembly capable of forming and transferring an image to a substrate, and having a chamber containing the UV-curable liquid toner composition described hereinabove; and at least one UV irradiation source for curing the image onto the substrate.

According to further features in embodiments of the invention described below, the imaging assembly comprises a movable imaging surface capable of carrying a latent image thereon, an exposing unit capable of emitting light on the imaging surface so as to form the latent image thereon; and a developing unit being in fluid communication with the chamber, for applying the UV-curable liquid toner composition onto the imaging surface, thereby to provide a developed image.

According to still further features in the described embodiments the imaging surface is embodied on a rotating drum.

According to still further features in the described embodiments the imaging assembly further comprises a charging unit, for uniformly charging the imaging surface.

According to still further features in the described embodiments the developing unit comprises at least one electrode operable to apply the UV-curable liquid toner composition on the imaging.

According to still further features in the described embodiments the imaging assembly further comprises a squeegee being in contact with the imaging surface, for squeezing the UV-curable liquid toner composition on the imaging surface.

According to still further features in the described embodiments the imaging assembly further comprises an intermediate transfer member, oppositely moving relative to the imaging surface and configured to receive the developed image from the imaging surface, and to transfer the developed image to a substrate.

According to still further features in the described embodiments the developing unit is designed and constructed to apply different colors of the UV-curable liquid toner composition on the imaging surface.

According to still further features in the described embodiments the developing unit comprises a development roller being spaced apart from the imaging surface, thereby forming a gap between the development roller and the imaging surface.

According to still further features in the described embodiments the developing unit further comprises a multicolor liquid toner sprayer, designed and constructed to spray the UV-curable liquid toner composition onto a portion of the development roller, a portion of the imaging surface and/or a development region formed between the imaging surface and the development roller.

According to still further features in the described embodiments the developing unit comprises a development roller, a main electrode and a back electrode, the main electrode and a back electrode the having a gap therebetween and configured such that the UV-curable liquid toner composition is forced through the gap to at least partially plate the development roller.

The present invention successfully addresses the shortcomings of the presently known configurations by providing compositions, methods and apparatus for liquid electrostatic printing having properties far exceeding prior art.

Unless otherwise defined, all technical and scientific terms used herein have 5 the same meaning as commonly understood by one of ordinary skill in the art to which this invention belongs. Although methods and materials similar or equivalent to those described herein can be used in the practice or testing of the present invention, suitable methods and materials are described below. In case of conflict, the patent specification, including definitions, will control. In addition, the materials, methods, and examples are illustrative only and not intended to be limiting.

BRIEF DESCRIPTION OF THE DRAWINGS

The invention is herein described, by way of example only, with reference to the accompanying drawings. With specific reference now to the drawings in detail, it is stressed that the particulars shown are by way of example and for purposes of illustrative discussion of the embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

In the drawings.

DETAILED DESCRIPTION OF THE PREFERRED EMBODIMENT

The present embodiments are of compositions, methods and an apparatus which can be beneficially used in digital printing, particularly electrostatic printing, using liquid toner. Specifically, the present embodiments are of novel UV-curable liquid toner compositions, which can be used to increase the peeling and flaking resistance of a printed image and hence to improve the performance of the digital printing process.

Figure 1:
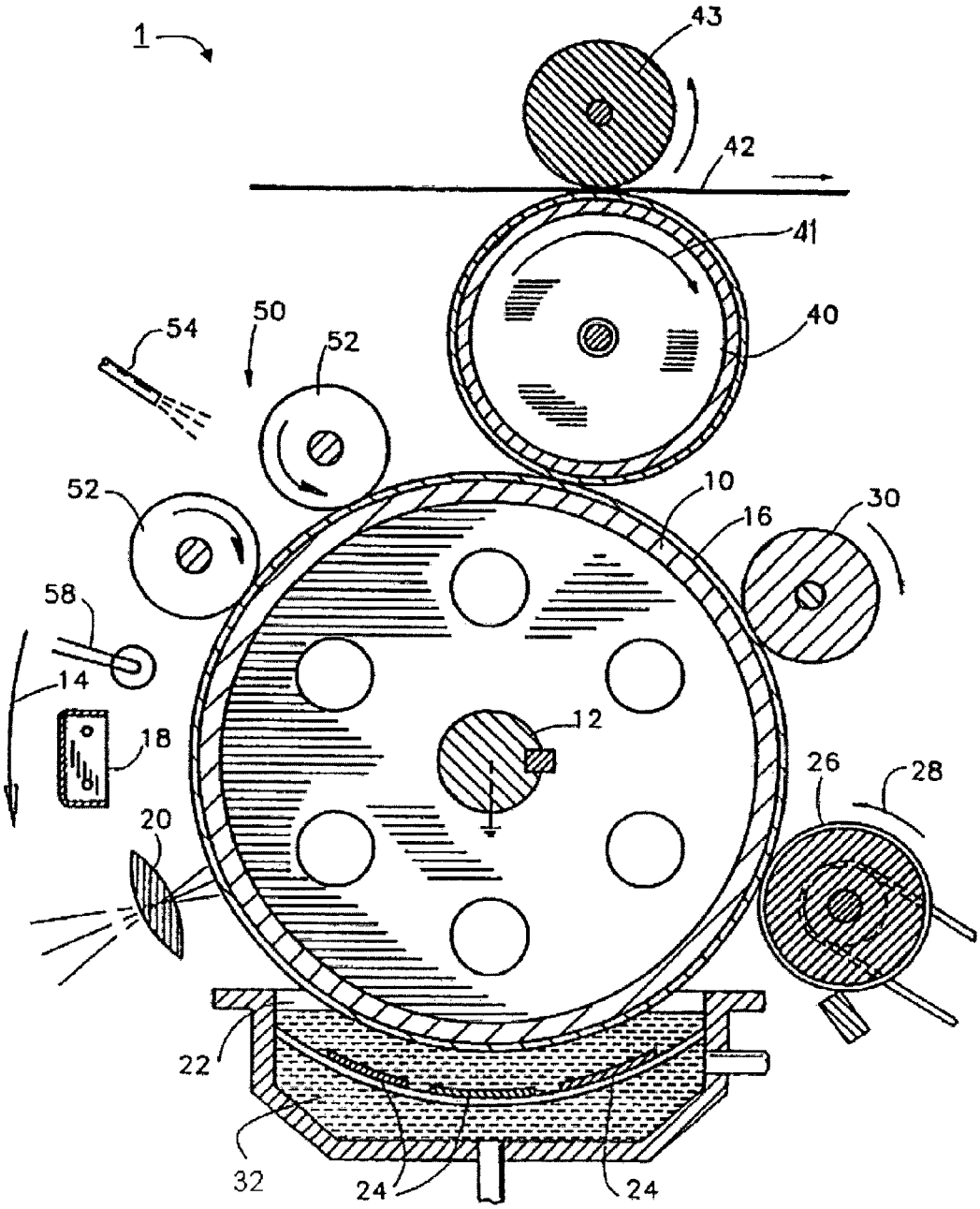
Fig. 1 (Prior Art)
FIG. 1 is a schematic illustration of a cross sectional view of an electrostatic printing apparatus, according to the teachings of the prior art.
Figure 2:
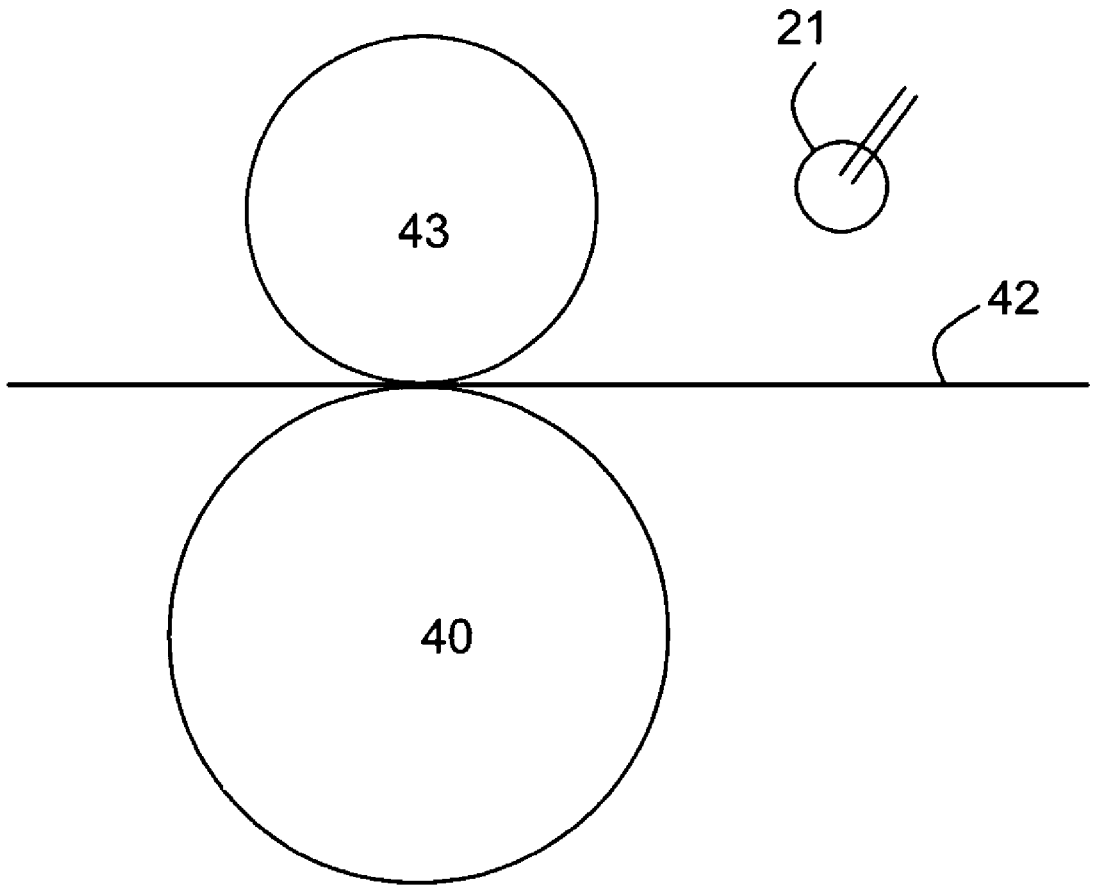
FIG. 2 is a schematic illustration of a portion of the apparatus of FIG. 1, adapted to be used according to an embodiment of the present invention.
Figure 3:
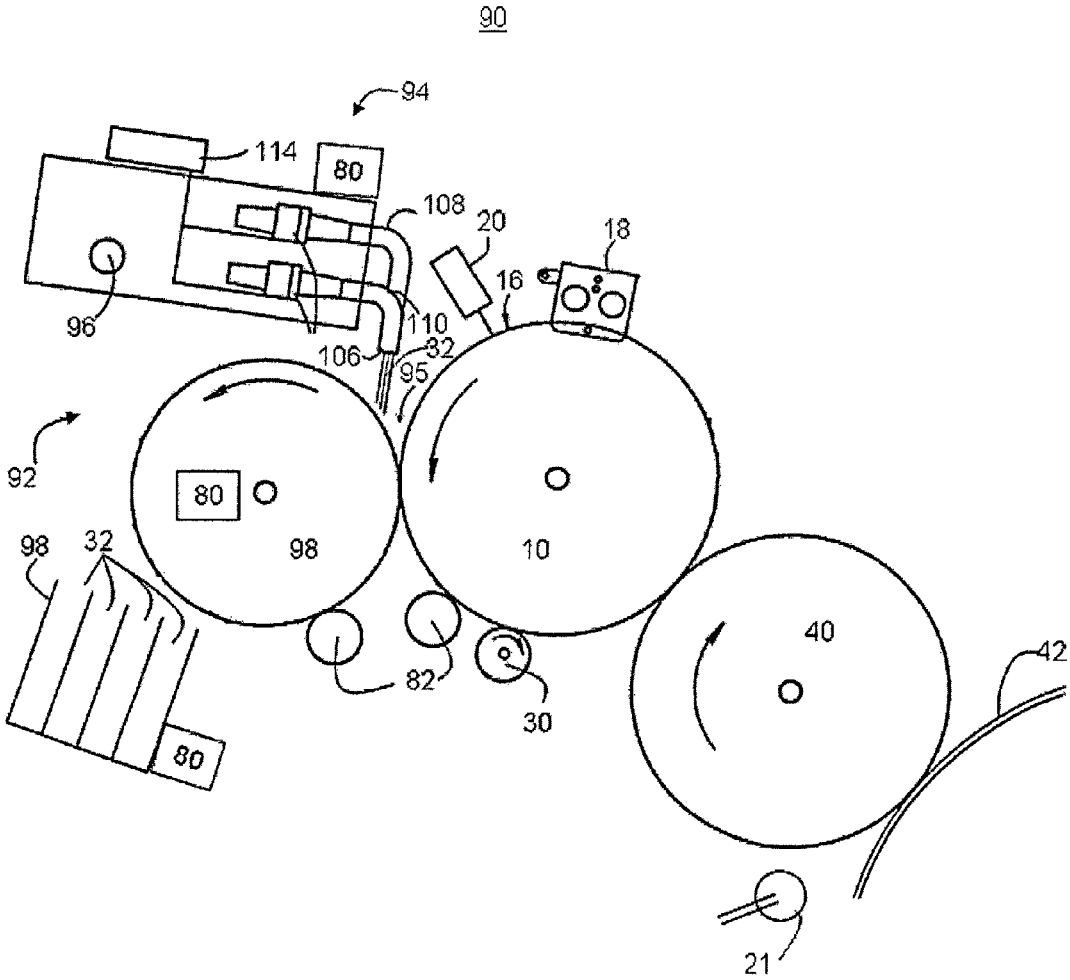
FIG. 3 is a schematic illustration of an electrostatic printing apparatus, according to another embodiment of the present invention.

For purposes of better understanding the present invention, as illustrated in FIGS. 2 and 3 of the drawings, reference is first made to the construction and operation of a conventional (i.e., prior art) electrostatic printing apparatus as illustrated in FIG. 1.

Before explaining at least one embodiment of the invention in detail, it is to be understood that the invention is not limited in its application to the details of construction and the arrangement of the components set forth in the following description or illustrated in the drawings. The invention is capable of other embodiments or of being practiced or carried out in various ways. Also, it is to be understood that the phraseology and terminology employed herein is for the purpose of description and should not be regarded as limiting.

Referring now to the drawings, FIG. 1 schematically illustrates a cross sectional view of an electrostatic printing apparatus 1, according to the teaching of prior art. Apparatus 1 comprises a drum 10 arranged for rotation about an axle 12 in a direction generally indicated by arrow 14. Drum 10 is formed with an imaging surface 16, e.g., a photoconductive surface. Surface 16 is typically of a cylindrical shape.

A charging unit 18, which can be a corotron, a scorotron, a roller charger or any other suitable charging unit known in the art, uniformly charges surface 16, for example, with positive charge.

Continued rotation of the drum 10 brings surface 16 into image receiving relationship with an exposing unit 20, which focuses a desired image onto surface 16. Unit 20 selectively discharges surface 16 in the areas struck by light, thereby forming the electrostatic latent image. Usually, the desired image is discharged by the light while the background areas are left electro statically charged. Thus, the latent image normally includes image areas at a first electrical potential and background areas at another electrical potential. Unit 20 may be a modulated laser beam scanning device, an optical focusing device or any other imaging device known in the art.

Continued rotation of the drum 10 brings imaging surface 16, now bearing the electrostatic latent image, into a developing unit 22, which typically comprises electrodes 24 operative to apply a liquid toner 32 on surface 16, so as to develop the electrostatic latent image.

Liquid toner 32 can comprise charged solid particulates dispersed in a carrier liquid. The solid particulates are typically charged to the same polarity of the photoconductor. Thus, due to electrostatic repulsion forces, ink particles adhere to areas on the photoconductor corresponding to the image regions, substantially without adhering to (developing) the background regions. In this manner a developed image is formed on surface 16.

Any liquid toner suitable for developing an electrostatic latent image can be used. One such liquid toner is known by the trade name ElectroInk®, commercially available from HP Indigo. This liquid toner is characterized by its comprising toner particulates dispersed in a carrier liquid, where the toner particulates are comprised of a core of a polymer with fibrous extensions extending from the core. When the toner particulates are dispersed in the carrier liquid in a low concentration, the particulates remain separate. When the toner develops an electrostatic image the concentration of toner particulates increases and the fibrous extensions interlock. A large number of patents and patent applications are directed toward this type of toner and charge directors which are comprised in it. These include, for example, U.S. Pat. Nos. 4,794,651; 4,842,974; 5,047,306; 5,407,307; 5,192,638; 5,208,130; 5,225,306; 5,264,312; 5,266,435; 5,286,593; 5,300,390; 5,346,796; 5,407,771; 5,554,476; 5,655,194; 5,792,584 and 5,5923,929, the disclosures of all of which are incorporated by reference as if fully set forth herein.

Following application of liquid toner 32 thereto, surface 16 passes a roller 26, which is typically charged to the same polarity as the toner particles and rotates in a direction indicated by an arrow 28. Roller 26 serves for reducing the thickness of liquid toner 32. Once surface 16 passes roller 26, region of the latent image are covered, substantially exclusively, by liquid toner 32.

A typical spatial separation of roller 26 from surface 16 is about 50 microns. The electric potential of roller 26 is typically intermediate the aforementioned first and second electric potential of the latent image areas and of the background areas on surface 16. Representative examples of voltage configuration include, without limitation, roller 26: from about +300 to about +500 volts, background area: about +50 volts and latent image areas: up to about +1000 volts.

As used herein the term "about" refers to ±10%.

Apparatus 1 may further comprise a squeegee 30, positioned downstream of roller 26, and is typically maintained in contacting or pressured relationship with surface 16. Squeegee 30 can be held at negative potential, e.g., from about 1000 to about 2000 volts, such that corona discharge takes place and electrical current flows from squeegee 30. Squeegee 30 repels the negatively charged particulates and causes them to more closely approach the image areas of surface 16, thus squeezing and rigidizing the liquid image thereon.

Once squeezed, the liquid image is transferred, typically via electrostatic attraction, to an intermediate transfer member 40, rotating in direction 41 which is opposite to direction 14 of drum 10. Subsequently, the image experiences a second transfer, typically aided by heat and pressure, from transfer member 40 to a substrate 42, which is supported by a roller 43.

Following the transfer of the liquid image to transfer member 40, surface 16 is engaged by a cleaning roller assembly 50, which typically comprises two oppositely rotating rollers 52 and a nozzle 54. Assembly 50 scrubs clean surface 16, e.g., using a cleaning material supplied by nozzle 54. Residual charge left on surface 16 can be removed, e.g., by flooding surface 16 with light from a lamp 58.

Utilizing conventional electrostatic printing techniques such as those employing apparatus 1 may result in insufficient adhesion and/or in non-continuous and non-uniform film of conventional liquid toners once transferred to substrate 42.

As stated in the Background section of the present disclosure, this drawback may lead to poor peeling and flaking resistance of the image and thus may affects its quality and durability.

As is further discussed in the Background section above, the presently known methods for improving the performance of liquid toners mainly involve the incorporation of various binding resins and other additives in the liquid toner or the use of increased concentration of the toner particles. However, these additives, as well as increased concentrations of the toner particles, oftentimes adversely affect other desired properties of the toner and therefore do not provide the required improvement in the image quality.

Other methods involve the use of UV-curable toners, whereby a major portion or the entire carrier consists of UV-curable compounds. As is discussed hereinabove, such compounds are likely to affect the charge characteristics and the humidity resistance of the toner, which may adversely affect the quality of the resulting image, and are further relatively expensive and therefore cost-inefficient.

Contrary to these prior art teachings, the present inventors have envisioned that UC-curable liquid toners can be obtained and successfully used in an imaging process by using a non-UV-curable liquid carrier such as the commonly used hydrocarbon-based carrier, incorporating therein a UV-curable component, in a relatively small concentration, and UV-irradiating the substrate after the liquid toner is transferred thereto. The present inventors have further envisioned that the addition of a UV-curable component in such a relatively small concentration will not affect the desired characteristics of the liquid toner during the image process, and will improve the quality and durability of the formed image once the liquid toner is transferred to the substrate.

While reducing the present invention to practice, such novel UV-curable liquid toner compositions have been designed and successfully prepared and utilized in liquid electrostatic printing processes. As is demonstrated in the Examples section that follows, by using these novel UV-curable liquid toner compositions, images with substantially improved performance, particularly in terms of peeling and flaking resistance, were obtained.

Thus, according to one aspect of the present invention there is provided a UV-curable liquid toner composition, which can be used in electrostatic printing. The composition comprises a dispersion of toner particles suspended in a hydrocarbon-based liquid carrier and at least one UV-curable component, such that the UV-curable component forms a part of the hydrocarbon-based liquid carrier.

As used herein, the phrase "hydrocarbon-based liquid carrier" refers to a liquid carrier that can be employed in liquid development process, e.g., is characterized by required properties such as, for example, volatility, low viscosity and the like, whereby the substances comprising the carrier are mainly hydrocarbons.

The term "hydrocarbon", as is well known in the art, describes compounds that mainly include carbon and hydrogen atoms covalently linked therebetween, such as alkanes, alkenes (olefins), cycloalkanes, aryls and the like. Hydrocarbons are typically devoid of functional groups that include other atoms such as oxygen and nitrogen.

As used herein, the term "mainly" with regard to a chemical substance, mixture or composition, refers to a large portion of the substance, mixture or composition, whereby this portion is at least 80 weight percentages, at least 85 weight percentages, at least 90 weight percentages, at least 95 weight percentages or at least 99 weight percentages.

A dispersion of toner particles in a hydrocarbon-based carrier is commonly used in printing systems as being the liquid developer in these systems. Thus, any toner particles and any hydrocarbon-based liquid carrier that are commonly used in liquid developing processes are suitable for use in the context of the present invention.

Examples of hydrocarbon-based carrier that can be efficiently used in the context of the present invention therefore include, without limitation, one or more of several hydrocarbons conventionally employed for liquid development processes. These include, for example, high purity alkanes having from about 6 to about 14 carbon atoms, such as Norpar®12, Norpar®13, and Norpar®15, available from Exxon Corporation, and isoparaffinic hydrocarbons such as Isopar®G, H, L, and M, available from Exxon Corporation, Amsco®460 Solvent, Amsco®OMS, available from American Mineral Spirits Company, Soltrol®, available from Phillips Petroleum Company, Pagasol®, available from Mobil Oil Corporation, Shellsol®, available from Shell Oil Company, and the like.

Particularly suitable hydrocarbon-based liquid carriers for use in the context of the present invention include isoparaffinic hydrocarbons such as the Isopar®G, Isopar®H, Isopar®L, and Isopar®M carriers described hereinabove. Such liquid carriers are highly advantageous since they are colorless, environmentally safe, and possess a sufficiently high vapor pressure so that a thin film of the liquid evaporates from the contacting surface within seconds at ambient temperatures.

Generally, the liquid carrier is present in a large amount in the composition of the present invention, and constitutes that percentage by weight of the developer not accounted for by the other components. The hydrocarbon-based liquid carrier is typically present in an amount of from about 80 weight percentages to about 98 weight percentages from the total amount of the composition, from about 85 weight percentages to about 98 weight percentages, or from about 90 weight percentages to about 98 weight percentages, although this amount may vary from this range provided that the objectives of the present invention are achieved.

The toner particles dispersed in the liquid carrier can be any colored particle compatible with the liquid carrier. For example, the toner particles can consist solely of pigment particles, or may comprise a resin and a pigment; a resin and a dye; or a resin, a pigment, and a dye. The resins, pigments and dyes can be any of those commonly used in liquid developing processes, as described, for example, in U.S. Pat. Nos. 4,794,651; 4,842,974; 5,047,306; 5,407,307; 5,192,638; 5,208,130; 5,225,306; 5,264,312; 5,266,435; 5,286,593; 5,300,390; 5,346,796; 5,407,771; 5,554,476; 5,655,194; 5,792,584; 5,5923,929; 5,574,547 and 5,558,970.

Liquid developers typically further include a charge control agent, also referred to in the art as a charge director. The compositions according to the present invention may therefore further comprise one or more charge control agent(s) such as, for example, lecithin (Fisher Inc.); OLOA 1200, a polyisobutylene succinimide available from Chevron Chemical Company; basic barium petronate (Witco Inc.); zirconium octoate (Nuodex); salts of calcium, manganese, magnesium and zinc; heptanoic acid; salts of barium, aluminum, cobalt, manganese, zinc, cerium, and zirconium octoates; salts of barium, aluminum, zinc, copper, lead, and iron with stearic acid; and the like. The charge control additive may be present in an amount of from about 0.01 to about 3 percent by weight, or from about 0.02 to about 0.05 percent by weight of the composition.

A particularly suitable liquid developer that comprises a dispersion of toner particles in a hydrocarbon-based carrier in the context of the present invention is the 5 ElectroInk® described hereinabove.

The UV-curable component according to the present invention may include a compound or a mixture of compounds that is reactive under UV-irradiation and thus can undergo a curing process upon exposure to UV irradiation. Thus, the UV-curable component optionally comprises one or more UV-polymerizable compound(s).

As used herein, the term "UV-polymerizable compound" describes any monomer, dimer or oligomer that tends to undergo a curing process which involves polymerization or cross-linking reactions when exposed to UV irradiation, as is detailed hereinunder.

According to embodiments of the present invention, once the UV-polymerizable compound is exposed to UV irradiation, a polymer or a resin thereof is formed onto or within the toner particles that form the image on the substrate. In one embodiment, during the UV-induced polymerization of the UV-polymerizable compound, the polymer is formed while being chemically grafted within or onto the surface of the toner particles. As is discussed hereinabove, the UV-curable component is present in the composition of the present invention in a relatively small concentration, so as to not affect the desired properties of the liquid developer.

Hence, according to an embodiment of the present invention the concentration of the UV-curable component ranges from about 0.5 weight percentage to about 5 weight percentages, from about 0.5 weight percentages to about 4 weight percentages of the total weight of the composition, from about 1 weight percentages to about 4 weight percentages of the total weight of the composition, from about 1 weight percentages to about 3 weight percentages of the total weight of the composition, or from about 1.5 weight percentages to about 2.5 weight percentages of the total weight of the composition.

The UV-curable component is desirably a non-volatile component. Thus, the concentration of the UV-curable component increases as the printing process proceeds, resulting in high concentrations thereof at the final stage, before transferring the toner to the substrate.

The UV-curable component is further desirably selected as having a lower viscosity as compared with the solid particles in the liquid developer, such that its binding to the substrate is better that that of the toner particles. Since when transferred to the substrate, the concentration of the UV-curable component in the composition is relatively high, its presence substantially enhances the adhesion of the toner composition to the substrate, even before the curing process is applied.

The UV-curable component may further desirably be selected as highly reactive when exposed to UV irradiation. The latter characteristic is particularly important due to the relative volatility of the liquid carrier. As described in the Background section above, one of the features associated with conventional liquid toners is the immediate evaporation of the liquid carrier once transferred onto the substrate, which may lead to the formation of a non-continuous and/or non-uniform image. Thus, it is desired that the curing process will be performed at a rate higher than that of the carrier evaporation.

The UV-polymerizable compounds according to the present invention can include monomers, dimers or polymers of compounds such as, for example, acrylates and methacrylates, vinyl ethers, styrenes, indenes, alpha-olefins, butadienes, epoxides and the like.

However, as is discussed hereinabove, UV-polymerizable compounds that can be beneficially used in the context of the present invention are those which are non-volatile, have a relatively low viscosity and are highly reactive when exposed to UV irradiation.

A family of compounds that is typically characterized by such properties in the acrylates.

Hence, according to an embodiment of the present invention, the UV-polymerizable compound comprises an acrylate or a mixture of acrylates. The acrylates can be monoacrylates or diacrylates.

Representative examples of monoacrylates that are usable in the context of the present invention include, without limitation, ethyl acrylate, methyl acrylate, n-butyl acrylate, isobutyl acrylate, propyl acrylate, 2-ethylhexyl acrylate, stearyl acrylate, isobornyl acrylate, phenoxyethyl acrylate, tetrahydrofurfuryl acrylate, lauryl acrylate, octyl acrylate, decyl acrylate and isodecyl acrylate.

Representative examples of diacrylates that are usable in the context of the present invention include, without limitation, hexanediol diacrylate, dipropylene glycol diacrylate (DPGDA), and polyethylene glycol diacrylate.

Additional acrylates that are usable in the context of the present invention include, for example, acrylates of polyurethane, polyester, polyether, melamine or epoxy resins, and ethoxylated or propoxylated derivatives of any of the aforementioned acrylates.

The UV-curable component can therefore comprise at least one diacrylate as a UV-polymerizable compound. As is well known in the art, diacrylates, by being bifunctional, are highly reactive in photopolymerization and yield polymers with higher degree of cross-linking as compared with monoacrylates. UV-curable compositions which include a diacrylate as the UV-polymerizable compound are therefore highly reactive in the curing process, and are farther characterized by flexibility and good adhesion to the substrate.

On the other hand, monoacrylates, and particularly cyclic monoacrylates such as isobornyl acrylate, although being less reactive in photopolymerization, are advantageously characterized by low viscosity, which provides for enhanced adhesion to the substrate, as is discussed hereinabove. Polymers obtained by photopolymerization of monoacrylates are further characterized by a high glass transition temperature (Tg), which provides for improved hardness of the flint In an embodiment of the present invention, the concentration of the UV-polymerizable compound in the UV-curable component of the present invention ranges from about 75 weight percentages to about 95 weight percentages, from about 80 weight percentages to about 95 weight percentages, from about 85 weight percentages to about 95 weight percentages, or from about 85 weight percentages to about 90 weight percentages.

The UV-curable component of the present invention may further comprise one or more photoinitiators. The photoinitiator is added so as to initiate the curing process once the composition is exposed to UV irradiation, typically by producing free radicals.

Representative examples of photoinitiators that are usable in the context of the present invention include, without limitation, benzophenone, 1-hydroxycyclohexyl phenyl ketone, 2-benzyl-2-dimethylamino-(4-morpholinaphenyl)butan-1-one, benzyl dimethylketal, isopropylthioxanthone, ethyl-4-(dimethylamino)benzoate, bis(2,6-dimethylbenzoyl)-2,4,4-trimethylpentylphosphine oxide and any mixture thereof.

According to an embodiment of the present invention, the photoinitiator is isopropylthioxanthone. According to another embodiment, isopropylthioxanthone is used in combination with a co-initiator such as ethyl-4-(dimethylamino) benzoate.

The concentration of the photoinitiator(s) in the UV-curable component of the present invention typically ranges from about 5 weight percentages and about 15 weight percentages, from about 5 weight percentages and about 10 weight percentages, or is about 10 weight percentages.

The UV-curable component of the present invention may further comprise a stabilizer such as, for example, tris(N-nitroso-N-phenylhydroxylamine) Aluminium 15 salt (N-PAL).

In an embodiment of the present invention, the concentration of the stabilizer ranges from about 0.1 weight percentage and about 1 weight percentage, from about 0.1 weight percentage and about 0.5 weight percentage, or from about 0.1 weight percentage and about 0.2 weight percentage.

Thus, according to an embodiment of the present invention, the UV-curable liquid toner composition comprises about 2 weight percentages of toner particles; about 0.5-5 weight percentages of one or more UV-curable component (s); and about 90-97.5 weight percentages of a hydrocarbon-based liquid carrier, whereby the amount of the carrier depends on the relative amounts of the other components in the composition. The composition may further comprise additives such as charge directors and any other additives that are commonly used in liquid developing and do not adversely affect the desired characteristics of the composition.

According to another embodiment of the present invention, the UV-curable liquid toner composition comprises about 0.5-5 weight percentages of one or more 30 UV-curable components and ElectroInk®.

Exemplary UV-curable components according to the present embodiments comprise about 75-95 weight percentages of one or more UV-polymerizable compound such as a monoacrylate and a diacrylate and any combination thereof; whereby exemplary UV-polymerizable compounds include, without limitation, dipropylene glycol diacrylate, isobornyl acrylate and isodecyl acrylate; about 5-10 weight percentages of one or more photoinitiator(s); and about 0.1-0.5 weight percentages of one or more stabilizer(s).

The UV-curable compositions of the present invention can be prepared by any methods known in the art for preparing liquid toner compositions. However, since the composition includes a hydrocarbon-based liquid carrier, which is typically a non-polar substance, UV-curable components such as those described hereinabove, which comprise salts and other polar compounds are insoluble in such a carrier.

Due to the nature of an electrostatic printing process employing a liquid toner, it is desired that the liquid toner would be relatively transparent. It is therefore desired that the UV-curable compositions described herein should be relatively transparent, such that the UV-curable component is substantially dissolved in the carrier.

To that end, the present inventors have developed and practiced a process for the preparation of the UV-curable liquid toner composition describe above.

The process is effected by first providing the UV-curable component and thereafter dissolving the UV-curable component in a dispersion of the toner particles in the hydrocarbon-based liquid carrier.

Providing the UV-curable component is typically effected by dissolving polar compounds such as the photoinitiators and the stabilizers in the UV-polymerizable compound and thereafter dissolving the resulting solution in the hydrocarbon-based liquid carrier dispersion.

Without being bound to any particular theory, it is assumed that the UV-polymerizable compounds, by being relatively non-polar organic substances and still typically having a partial polarity due to the presence of functional groups therein, act as surfactants, which facilitate the solubilization of polar compounds in the non-polar carrier. It is further assumed that non-polar UV-polymerizable compounds such as acrylates, form complexes with the polar compounds, and thus reduce the polarity of these compounds. These complexes can therefore be completely dissolved in the non-polar carrier.

As is described in detail and exemplified in the Examples section that follows, preparing the UV curable compositions of the present invention using this process provides for a complete solubilization of the UV-curable component in the liquid carrier, using an efficient yet simple, safe and easy to perform process.

As is further demonstrated in the Examples section that follows, the UV-curable compositions of the present invention have been successfully utilized in an imaging process and apparatus, resulting in images with enhanced peeling and flaking resistance as compared with non-UV-curable compositions.

Reference is now made to FIG. 2 which is a schematic illustration of a portion of apparatus 1, adapted to be used with the UV-curable liquid toner composition of the present embodiments. Shown in FIG. 2 are intermediate transfer member 40, substrate 42 and roller 43. Other components of apparatus 1, are not shown for the sake of conciseness. Hence, according to various exemplary embodiments of the present invention, apparatus 1 is used for forming an image using the UV-curable liquid toner composition of the present embodiments. This can be done, for example, by replacing liquid toner 32 of apparatus 1 with the composition of the present embodiments and operating apparatus I as further detailed hereinabove.

According to an embodiment of the present invention apparatus I is supplemented by an ultraviolet (UV) light source 21, for irradiating the image by UV irradiation once the image is transferred to substrate 42. The UV irradiation serves for curing the UV-curable toner image onto substrate 42.

Reference is now made to FIG. 3 which is a schematic illustration of a liquid electrostatic printing apparatus 90, according to another embodiment of the present invention. Apparatus 90 is typically used for multicolor printing. In its simplest configuration, apparatus 90 comprises an imaging assembly 91 for forming and transferring the image to substrate 42 and a UV light source 21, for irradiating the image by UV irradiation.

Assembly 91 may comprise any of the elements of apparatus 1, including, without limitation, drum 10, imaging surface 16, charging unit 18, exposing unit 20, squeegee 30 and transfer member 40, all of which can be constructed to operate as further detailed hereinabove or in any other way known in the art.

System 91 further comprises a developing unit 92 for applying the UV-curable liquid toner composition of the present embodiments, designated in FIG. 2 by numeral 100, on imaging surface 16. Developing unit 92 is typically designed and constructed to apply different colors (e.g., 4, 5, 6, 7 colors or more) of composition 100 on imaging surface 16 in a synchronized fashion. For example, developing unit 92 can periodically apply a different color for each rotation cycle of drum 10.

In the embodiment shown in FIG. 3, developing unit 92 comprises a development roller 98, which is typically spaced from surface 16 thereby forming a gap between development roller 98 and surface 16. Typically, the spacing is from about 40 pm to about 150 pm. Development roller 98 is charged to an electrical potential intermediate that of the image and its background areas. Development roller 98 is thus operative when maintained at a proper voltage to apply an electric field to aid development of the latent electrostatic image.

Development roller 98 typically rotates in the same sense as drum 10. This rotation provides for surface 16 and roller 98 to have opposite velocities in their region of propinquity.

According to an embodiment of the present invention developing unit 92 further comprises a multicolor liquid toner sprayer 94, mounted on an axis 96 to allow sprayer 94 to be pivoted in such a manner that a spray of composition 100 can be directed either onto a portion of development roller 98, a portion of surface 16 or directly into a development region 95 between surface 16 and roller 98. Sprayer 94 typically receives separate supplies of colored liquid toner from different reservoirs 98. Any number of reservoirs can be used, depending on the desired number of colors. According to an embodiment of the present invention sprayer 94 comprises a linear array of spray outlets 106, each of which communicates with a different reservoir, e.g., via a specific conduit (not shown). Spray outlets 106 are typically interdigitated such that when N colors are used, every Nth outlet sprays the same color, and every group of N adjacent outlets includes outlets which spray N different colors. The flow of composition 100 to each of outlet can be controlled by a controller 114. Outlets 106 are typically positioned at two or more levels (designated 108 and 110) to permit the minimization of separation between the outlets.

Composition 100 is sprayed under pressure from each of outlets 106 into development region 95, a portion of development roller 98 and/or a portion of imaging surface 16. According to an embodiment of the present invention, the spacing of spray outlets 106 and their periodicity is selected to enable the toner for each individual given color to substantially uniformly fill region 95. This can be achieved by a substantially uniform array. Alternatively, the colors are grouped in clusters each of which contains one outlet for each color. Typically these clusters have a center to center spacing of from about 40 mm to about 60 mm.

The image can be transferred from surface 16 to substrate 42 in any way known in the art. In the exemplary embodiment shown in FIG. 3, the image is first transferred to member 40 and thereafter to substrate 42, as further detailed hereinabove.

In any event, once the image is transferred to substrate 42, W light source 21 irradiates the image by UV irradiation, thus activating the curing process of the image.

Additional objects, advantages and novel features of the present invention will become apparent to one ordinarily skilled in the art upon examination of the following examples, which are not intended to be limiting. Additionally, each of the various embodiments and aspects of the present invention as delineated hereinabove and as claimed in the claims section below finds experimental support in the following examples.

EXAMPLES

Reference is now made to the following example, which, together with the above descriptions, illustrates the invention in a non limiting fashion.

Materials and Experimental Methods

Chemicals:

Additol ITX (isopropyl thioxanthone), and Additol EPD (ethyl-4-(dimethylamino)benzoate) were purchased from UCB.

Tris(N-nitroso-N-phenylhydroxylamine) Aluminium salt (N-PAL) was purchased from Albemarle.

DPGDA (Dipropylene glycol di-acrylate) was purchased from UCB, IOBA (Isobornyl acrylate) and Isodecyl acrylate were purchased from Sartomer.

UV Irradiation (Off-Line Experiments):

UV Irradiation was performed in SPECTRUM (RANAR) using a 300 5 Watts/inch, medium pressure mercury lamp attached to a conveyor, under the following conditions:

Total energy dose (per/pass): 290 milli joules/cm$^2$ (UVA=185; UVB=69; UVC=7; UVV=29); Conveyer Speed: 20 feet/minute.

UV Irradiation ("On-Line" Experiments Combining On-Line Printing Process 10 and Off-Line Irradiation):

A conventional liquid electrostatic printing apparatus, ULTRASTREAM®, supplied by the Assignee of the present invention, was used to evaluate the efficacy of the UV-curable liquid toner of the present invention. Electrostatic printing was performed under conventional printing conditions for Twister machine. UV irradiation was performed by applying irradiation on the printed papers offline, using the UV conveyorized system described above.

Peeling Resistance Measurements:

A piece of adhesive tape (3M, type 230, width 1 inch) was wedged (under a constant weight, 1 kg. roller, 10 passes) to a printed specimen (100% ink coverage, printed area 150 by 75 mm) and was thereafter stripped off from the specimen by printer operator. The resulting peeling was evaluated by scanning the tested prints and calculating the percentage of the white (peeled-off) areas.

Flaking Resistance Measurements:

The flaking resistance was measured using the "book" test procedure, as follows: two 200% coverage prints were rubbed one against the other 40 times under 1 kg weight, 10 minutes after printing. Rubbing was performed either manually or by using specially designed fixture. The resulting flaking was evaluated by scanning the tested prints and calculating the percentage of the white areas.

Preparation of a UV-Curable Liquid Toner

Preparation of a UV Formulation:

Using commonly used techniques, three exemplary UV formulations according to the present invention, as delineated in Table 1 below, have been prepared.

TABLE 1

| | UV-polymerizable compound (weight percentage) | Photoinitiator (weight percentage) | Stabilizer (weight percentage) |
|---|---|---|---|
| UV formulation I | IBOA (89.95) | Additol ITX and Additol EPD (10.00) | N-PAL (0.15) |
| UV formulation II | Isodecyl acrylate (89.95) | Additol ITX and Additol EPD (10.00) | N-PAL (0.15) |
| UV formulation III | DPGDA (89.95) | Additol ITX and Additol EPD (10.00) | N-PAL (0.15) |

UV-Curable Liquid Toner Compositions:

Using the UV formulations described hereinabove, exemplary UV-curable liquid toner compositions according to the present invention were prepared. Each composition comprised about 2 weight percentages of the UV formulation, incorporated in a liquid Isopar based ElectroInk®, supplied by the Assignee of the present invention. A typical ElectroInk® composition includes about 2 weight percentages solid particles (pigments and resins) and about 98 weight percentages isoparaffinic carrier liquid.

Preparation of a UV-Curable Composition:

In order to achieve a complete solubilization of the UV formulation in the Isopar liquid carrier, the following process for preparing a UV-curable liquid toner according to the present invention was developed and successfully performed:

As a first step, components of the UV formulation, which are typically insoluble in the Isopar liquid carrier, were dissolved in a medium containing one or more of the acrylate monomers of the selected UV formulation, by magnetically stirring the mixture. In a typical example, the photoinitiators Additol ITX and Additol EPD and a stabilizer were dissolved in DPGDA, by magnetically stirring the mixture for 2-4 hours at room temperature, to thereby produce a homogenous solution. The homogenous solution was thereafter completely and easily dissolved in a liquid Isopar based ElectroInk® by shaking the resulting mixture for 10 minutes.

Experimental Results

Off-Line UV-Irradiation Experiments:

Off-line experiments were conducted in order to evaluate the response of the compositions of the present invention to UV irradiation. To this end, compositions including 10-20 weight percentages of the UV formulations described above, incorporated in ElectroInk®, were prepared and irradiated as described in the methods section hereinabove.

The UV response of each composition was visually evaluated by detection of precipitation (evidence of cross-linking polymerization) and was further measured by the decrease of the double bonds absorption signal as a function of the number of passes underneath the UV lamp, as a result of the polymerization.

Figure 4:
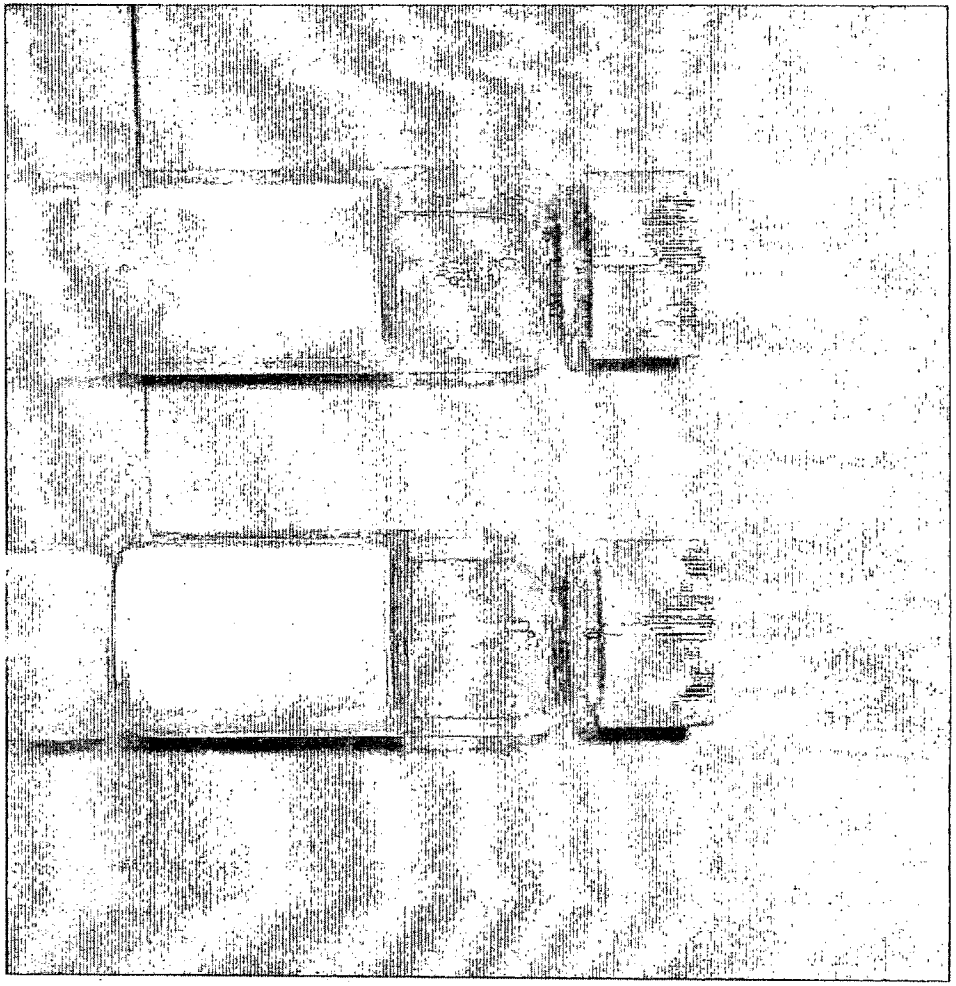
FIG. 4 presents photos of an exemplary ElectroInk® composition containing a UV formulation according to the present invention before (right-handed vile) and after (left-handed vile) UV-irradiation.

As is shown in FIG. 4, when a completely miscible ElectroInk® composition containing a UV formulation of the present invention (right-handed vile) was subjected to UV irradiation, precipitation of the resulting polymer was clearly observed (left-handed vile).

Comparing the results obtained with a UV formulation containing a diacrylate UV-polymerizable compound (DPDGA) and a monoacrylate UV-polymerizable compound (IOBA) indicated that a diacrylate-containing composition is more reactive than the monoacrylate-containing composition, having a faster response to UV irradiation and a higher degree of cross-linking. In a monoacrylate-containing composition, a color change was also observed following irradiation.

"On-Line" Experiments (Combining On-Line Printing and Off-Line Irradiation):

The peeling and flaking resistance of exemplary UV-curable liquid toner compositions according to the present invention were tested as described above, using the electrostatic apparatus described above and two different types of printed papers-Condat and BVS. The tested compositions included the UV formulations H and III described above, in an initial concentration about 2 weight percentages of the total weight of the tested composition. Peeling and flaking resistance of the obtained image were measured as described in the methods section above, with and without UV irradiation of the printed paper.

Figure 5A:
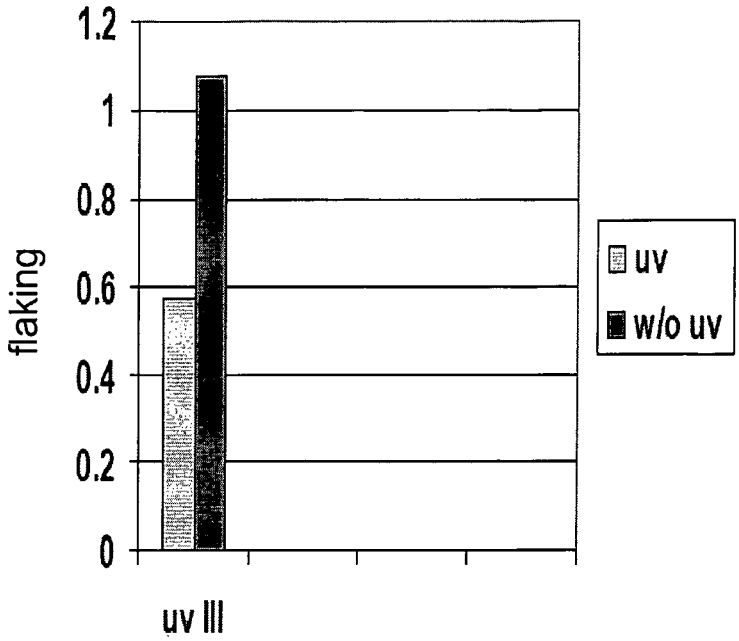
FIGS. 5(*a-b*) are bar graphs showing the improved flaking resistance (FIG. 5*a*) and peeling resistance (FIG. 5*b*) of an exemplary UV-curable liquid toner composition according to the present invention, containing UV formulation III on a Condat paper, with and without UV irradiation of the printed paper.
Figure 5B:
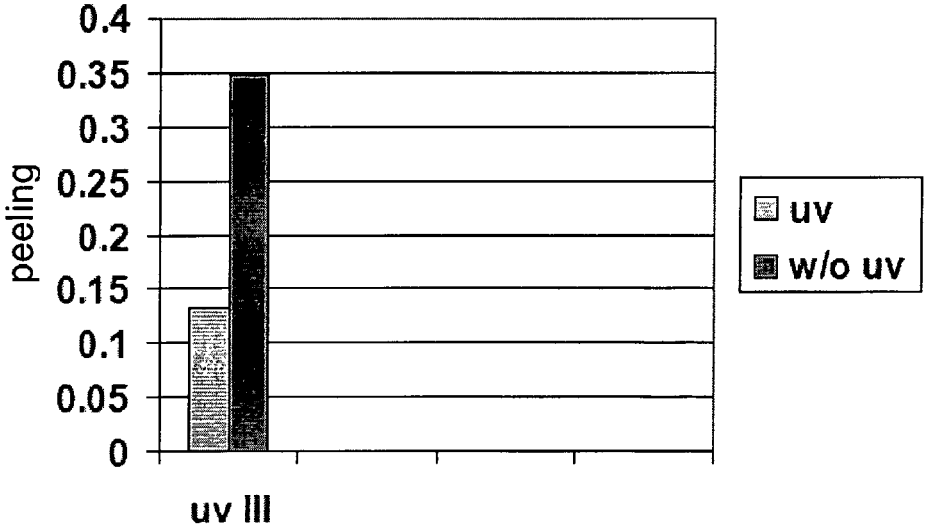
Figure 6A:
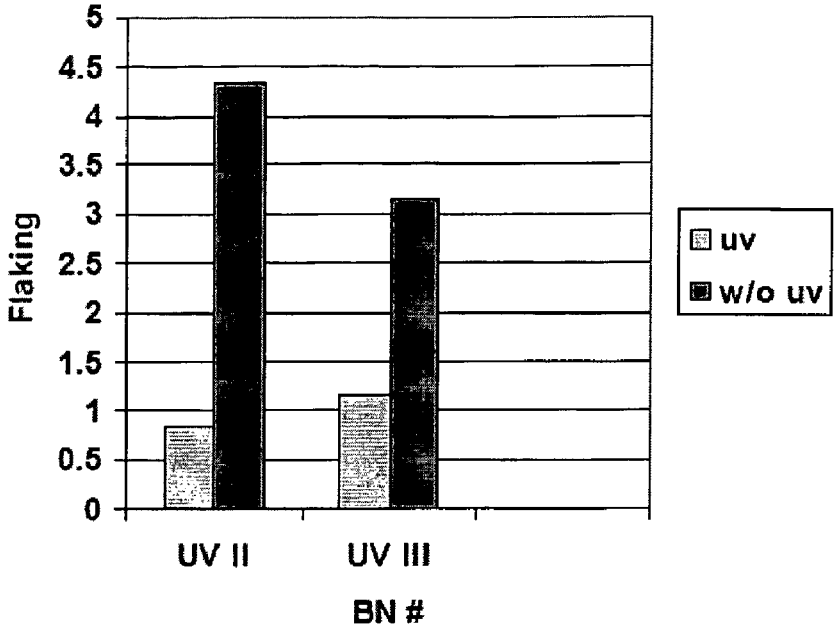
FIGS. 6(*a-b*) are bar graphs showing the improved flaking resistance (FIG. 6*a*) and peeling resistance (FIG. 6*b*) of two exemplary UV-curable liquid toner composition according to the present invention, containing UV formulation II or III, on a BVS paper, with and without UV irradiation of the printed paper.
Figure 6B:
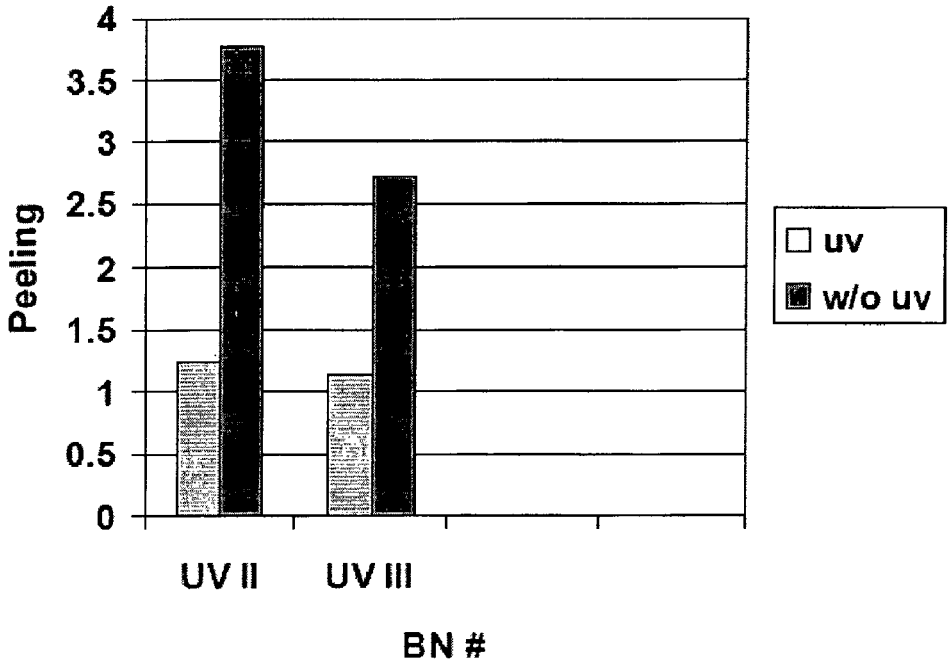

FIGS. 5 and 6 present some of the obtained data and clearly show that UV irradiation of the compositions of the present invention resulted in substantially improved peeling and flaking resistance in both Condat and BVS printed substrates.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable subcombination.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims. All publications, patents and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention.

What is claimed is:

1. A UV-curable liquid toner composition for use in liquid electrostatic printing comprising:
- a dispersion of toner particles suspended in a hydrocarbon-based liquid carrier; and
- at least one UV-curable component;
- wherein:
  - a concentration of the toner particles is about 2 percent by weight of a total weight of the composition;
  - a concentration of the at least one UV-curable component ranges from about 0.5 to about 5 percent by weight of the total weight of the composition; and
  - a concentration of the hydrocarbon-based liquid carrier ranges from 90 to 97.5 percent by weight of the total weight of the composition.

2. A process of preparing the UV-curable liquid toner composition of claim 1, the process comprising:
- providing said at least one UV-curable component;
- providing said dispersion of toner particles suspended in said hydrocarbon-based liquid carrier; and
- dissolving said at least one UV-curable component in said hydrocarbon-based liquid carrier, thereby providing the UV-curable liquid toner composition.

3. A method of forming an image on a substrate, the method comprising:
- providing the UV-curable liquid toner composition of claim 1;
- forming an electrostatic image on an imaging surface;
- developing said electrostatic image using said UV curable liquid toner composition, to thereby form a toner image containing said UV-curable composition;
- transferring said toner image to the substrate; and
- UV-irradiating the substrate, to thereby cure the image on the substrate.

4. The method of claim 3, wherein said forming said electrostatic image on said imaging surface comprises uniformly charging said imaging surface.

5. The method of claim 4, wherein said forming said electrostatic image on said imaging surface further comprises emitting light constituting an image on said imaging surface, so as to selectively discharge predetermined regions on said imaging surface.

6. The method of claim 3, wherein said developing said electrostatic image comprises charging said UV curable liquid toner composition and applying said UV curable liquid toner composition onto said imaging surface.

7. The method of claim 3, wherein said application of said UV curable liquid toner composition onto said imaging surface is by a sprayer.

8. The method of claim 3, wherein said application of said UV curable liquid toner composition onto said imaging surface is by a developing roller.

9. The method of claim 3, further comprising transferring said toner image to an intermediate transfer member, prior to said transfer of said toner image to the substrate.

10. The method of claim 3, further comprising squeezing said toner image prior to said transfer of said toner image to the substrate.

11. A liquid electrostatic printing apparatus, comprising:
- an imaging assembly for forming and transferring an image to a substrate, said imaging assembly having a chamber containing the UV-curable liquid toner composition of claim 1; and at least one UV irradiation source for curing said image onto said substrate.

12. The apparatus of claim 11, wherein said imaging assembly comprises a movable imaging surface for carrying a latent image thereon, an exposing unit for emitting light on said imaging surface so as to form said latent image thereon; and a developing unit being in fluid communication with said chamber, for applying said UV-curable liquid toner composition onto said imaging surface, thereby to provide a developed image.

13. The apparatus of claim 12, wherein said imaging surface is embodied on a rotating drum.

14. The apparatus of claim 12, wherein said imaging assembly further comprises a charging unit, for uniformly charging said imaging surface.

15. The apparatus of claim 12, wherein said developing unit comprises at least one electrode operable to apply said UV-curable liquid toner composition on said imaging.

16. The apparatus of claim 12, wherein said imaging assembly further comprises a squeegee being in contact with said imaging surface, for squeezing said UV-curable liquid toner composition on said imaging surface.

17. The apparatus of claim 12, wherein said imaging assembly further comprises an intermediate transfer member, oppositely moving relative to said imaging surface and configured to receive said developed image from said imaging surface, and to transfer said developed image to a substrate.

18. The apparatus of claim 12, wherein said developing unit selectively applies different colors of said UV-curable liquid toner composition on said imaging surface.

19. The apparatus of claim 18, wherein said developing unit comprises a development roller being spaced apart from said imaging surface, thereby forming a gap between said development roller and said imaging surface.

20. The apparatus of claim 18, wherein said developing unit further comprises a multicolor liquid toner sprayer, designed and constructed to spray said UV-curable liquid toner composition onto a portion of said development roller, a portion of said imaging surface and/or a development region formed between said imaging surface and said development roller.

21. The apparatus of claim 12, wherein said developing unit comprises a development roller, a main electrode and a back electrode, said main electrode and a back electrode said having a gap therebetween and configured such that said UV-curable liquid toner composition is forced through said gap to at least partially plate said development roller.

22. The UV-curable composition of claim 1, wherein said UV-curable component forms a part of said liquid carrier.

23. The UV-curable composition of claim 1, wherein a concentration of said at least one UV-curable component ranges from about 1 weight percentages to about 3 weight percentages of the total weight of the composition.

24. The UV-curable composition of claim 1, wherein said UV-curable component comprises at least one UV-polymerizable compound.

25. The UV-curable composition of claim 24, wherein said at least one UV-polymerizable compound comprises at least one acrylate.

26. The UV-curable composition of claim 25, wherein said at least one acrylate is selected from the group consisting of a monoacrylate, a diacrylate and a mixture thereof.

27. The UV-curable composition of claim 26, wherein said monoacrylate is selected from the group consisting of isodecyl acrylate and isobornyl acrylate.

28. The UV-curable composition of claim 26, wherein said diacrylate is dipropylene glycol diacrylate.

29. The UV-curable composition of claim 1, wherein a concentration of said UV-polymerizable compound ranges from about 75 weight percentages to about 95 weight percentages of the total weight of said UV-curable component.

30. The UV-curable composition of claim 1, wherein said UV-curable component further comprises at least one photoinitiator.

31. The UV-curable composition of claim 1, wherein said UV-curable component further comprises at least one stabilizer.

32. The UV-curable composition of claim 1, wherein said at least one UV-curable component comprises:

about 75-95 weight percentages of at least one UV-polymerizable compound selected from the group consisting of a monoacrylate and a diacrylate;

about 5-10 weight percentages of at least one photoinitiator; and about 0.1-0.5 weight percentages of at least one stabilizer.

33. The process of claim 2, wherein providing said at least one UV-curable component comprises:

dissolving said at least one photoinitiator and said at least one stabilizer in said at least one UV-polymerizable compound.

* * * * *